US010180025B2

(12) United States Patent
Conner

(10) Patent No.: US 10,180,025 B2
(45) Date of Patent: Jan. 15, 2019

(54) POWER CLOSURE PANEL SYSTEM PERFORMANCE OPTIMIZER

(71) Applicant: FORD GLOBAL TECHNOLOGIES, LLC, Dearborn, MI (US)

(72) Inventor: Greg Alan Conner, Ann Arbor, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 64 days.

(21) Appl. No.: 15/606,982

(22) Filed: May 26, 2017

(65) Prior Publication Data

US 2017/0342761 A1 Nov. 30, 2017

Related U.S. Application Data

(63) Continuation-in-part of application No. 15/162,996, filed on May 24, 2016, now Pat. No. 10,094,159.

(51) Int. Cl.

| | |
|---|---|
| ***E05F 15/71*** | (2015.01) |
| ***E05F 15/77*** | (2015.01) |
| ***G07C 9/00*** | (2006.01) |
| ***E05F 1/10*** | (2006.01) |

(Continued)

(52) U.S. Cl.
CPC ..... *E05F 15/71* (2015.01); *E05F 1/1091* (2013.01); *E05F 15/622* (2015.01);
(Continued)

(58) Field of Classification Search
CPC ..... E05F 15/71; E05F 1/1091; E05F 15/622; G07C 9/00007; E05Y 2900/546;
(Continued)

(56) References Cited

U.S. PATENT DOCUMENTS 6,516,567 B1 2/2003 Stone et al.
6,719,356 B2 4/2004 Cleland et al.
(Continued)

FOREIGN PATENT DOCUMENTS

DE 102006049544 A1 4/2008
DE 102006057889 A1 6/2008
(Continued)

OTHER PUBLICATIONS

English Machine Translation of DE102006049544A1.
(Continued)

*Primary Examiner* — D Glenn Dayoan
*Assistant Examiner* — Melissa A Black
(74) *Attorney, Agent, or Firm* — Jason Rogers; King & Schickli PLLC

(57) ABSTRACT

A power optimizer system for power closure panels includes a closure panel power actuator system comprising at least a motor operatively connected to a vehicle closure panel. A controller is configured to determine an optimal electrical current draw for the power actuator system according to one or more inputs relating at least to a vehicle battery status, a vehicle ambient temperature, a vehicle grade, and a vehicle climate control system status. Methods of modeling/optimizing the appropriate electrical current draw for power closure systems operating in varying voltage, temperature, grade, and climate control system conditions relative to a vehicle, or other similar mechanisms are also described.

19 Claims, 3 Drawing Sheets

(51) Int. Cl.
*E05F 15/622* (2015.01)
*B60J 5/10* (2006.01)

(52) U.S. Cl.
CPC ..... *G07C 9/00007* (2013.01); *E05Y 2400/30* (2013.01); *E05Y 2400/36* (2013.01); *E05Y 2400/44* (2013.01); *E05Y 2400/45* (2013.01); *E05Y 2400/612* (2013.01); *E05Y 2800/404* (2013.01); *E05Y 2800/414* (2013.01); *E05Y 2900/50* (2013.01); *E05Y 2900/546* (2013.01)

(58) Field of Classification Search
CPC ..... E05Y 2400/30; E05Y 2400/36; E05Y 2400/44; E05Y 2400/45; E05Y 2400/612; E05Y 2800/404; E05Y 2900/50
See application file for complete search history.

(56) References Cited

U.S. PATENT DOCUMENTS

| | | | |
|---|---|---|---|
| 6,755,458 | B1 | 6/2004 | Oberheide |
| 7,055,885 | B2 | 6/2006 | Ishihara et al. |
| 8,428,828 | B2 | 4/2013 | Serban et al. |
| 2002/0180269 | A1 | 12/2002 | Dalakuras et al. |
| 2004/0090083 | A1 | 5/2004 | Greuel et al. |
| 2004/0124662 | A1 | 7/2004 | Cleland et al. |
| 2005/0168010 | A1 | 8/2005 | Cleland et al. |
| 2005/0264029 | A1 | 12/2005 | Bodner |
| 2006/0181108 | A1 | 8/2006 | Cleland et al. |
| 2015/0096233 | A1 | 4/2015 | Kojima et al. |
| 2015/0284983 | A1 | 10/2015 | Conner et al. |

FOREIGN PATENT DOCUMENTS

| | | | |
|---|---|---|---|
| DE | 102007006336 | A1 | 8/2008 |
| DE | 102008022870 | B2 | 6/2009 |
| DE | 102009043037 | A1 | 4/2011 |

OTHER PUBLICATIONS

English Machine Translation of DE102006057889A1.
English Machine Translation of DE102007006336A1.
English Machine Translation of DE102008022870B2.
English Machine Translation of DE102009043037A1.

POWER CLOSURE PANEL SYSTEM PERFORMANCE OPTIMIZER

This application is a continuation-in-part of U.S. patent application Ser. No. 15/162,996 filed on 24 May 2016, now U.S. Pat. No. 10,094,159.

TECHNICAL FIELD

This disclosure relates generally to power closure panel systems for vehicles. More particularly, the disclosure relates to a performance optimizer for a power closure panel, wherein the system reacts to various environmental and other conditions to design and/or modify operation and speed of a power actuator and lift-assist mechanism. By the described system, excessive electrical current draw of the power actuator/lift-assist mechanism can be anticipated due to sensor inputs, and the current draw can be minimized, refining performance for longer component life and faster product development.

BACKGROUND

It is known to provide vehicles with powered closure panels such as liftgates, decklids, side-doors, tailgates, movable glass panels, hoods, tonneau covers, and others. The power-assisted closure panels may be operated by a number of mechanisms, including without intending any limitation key fob switches, dash panel switches, liftgate switches, motion sensors, voice-command sensors, associated with the closure panels, and others. Typical power controlled closure panels include a power actuator such as a motor and gearing providing sufficient torque to translate the closure panel between an open and a closed configuration. Other conventional power controlled systems include pneumatic cylinders or hydraulic systems having motor-driven fluid pumps, and unpowered mechanical assist components that work in conjunction with a standalone powered motor or actuator.

It is also known to provide lift-assist mechanisms for power controlled closure panels. Such lift assist mechanisms include torsion bars, torsion springs, air spring cylinders, tension springs, counterbalance struts, and others. Lift assist mechanisms reduce the load on the power actuator used to translate the closure panel between the open and the closed configuration. This allows use of much smaller motors, making optimization of performance all the more important and significant in achieving longer component life.

Still more, it is known to provide programmable power-assisted closure panels. As examples, a height to which a power closure panel such as a decklid or liftgate may be pre-programmed or predetermined, to avoid having the panel strike an overlying low surface such as a parking garage roof, sprinkler head, or the like. Moreover, it is known to provide a "stop and hold" function whereby the power closure panel may be stopped manually or automatically such as by a sensor to avoid contacting an obstacle during an opening or closing operation. A representative system providing such a "stop and hold" function is described in U.S. Pat. No. 7,547,058, the entirety of the disclosure of which is incorporated herein by reference.

Various environmental factors may affect power closure panel performance. As non-limiting examples, it is known that extremes of temperature and grade (i.e., a nose-up or nose-down orientation of a vehicle or the angle at which a vehicle is oriented relative to a horizontal plane) affect performance of power closure panels. In such conditions, the torque required for the power assist mechanism increases, and therefore the electrical current draw required by the power actuator likewise increases. For example, when a vehicle is positioned on level ground and/or at normal ambient temperature, a power controlled mechanism must apply a certain amount of opening/closing torque or force and braking to translate the closure panel between an open and a closed configuration. On a grade positioning the vehicle in a nose-down orientation, the closure panel must be pulled "uphill" in order to close the panel, and an increased amount of torque or force is required. On a grade positioning the vehicle nose-up, additional dynamic braking or force is required to prevent the closure panel from overextending during opening. At low temperatures, electrical systems become more efficient and therefore can be operated at a reduced electrical current draw compared to higher temperatures.

For programmable power-assisted closure panel mechanisms, the potential for extremes of temperature and grade must be factored into the programming, i.e. the programming must be configured to compensate for such potential extremes of grade and/or temperature. Conventional programmable power-assisted closure panels must be programmed by trial and error, and attempt to meet all conditions of voltage, temperature, grade, load on gate (for example, snow), etc. using a single performance sensor calibration by way of controlling speed of operation of the lift assist mechanism, for example a strut. Such conventional systems cannot automatically accommodate variations in operating conditions, for example extremes of voltage, temperature, grade, load on gate, etc., which significantly adversely affects the torque required of the power mechanisms and therefore the electrical current draw required for the power actuator to operate the closure panel. A generalized approach to operating a power closure system must ordinarily use current that would be higher than required as these systems have not had the benefit of being customized for the specific conditions of operation, adversely affecting component life.

To solve this and other problems, the present disclosure relates to a performance optimizing system for a power closure panel. The system is configured to adapt to varying conditions of voltage, temperature and grade extremes, and reacts to those conditions by altering the speed of the lift assist mechanism, by adjusting the power required to deliver optimized voltage and current that controls the closure panel opening/closing speed to achieve efficient function despite extreme conditions. The systems further adapt to other variables which can impact closure panel closing force (and thereby the required voltage/current that must be supplied to the power closure panel to ensure a proper panel closing force/speed) such as passenger cabin air pressure and air exhaustion rate. Such an intelligent system, having the environmental input knowledge, would allow for implementation of for example, a SNOW LOAD mode, or other specific conditions where special operating performance parameters are required and are user selectable convenience features.

SUMMARY

In accordance with the purposes and benefits described herein, in one aspect of the disclosure a power optimizer system for a vehicle is provided, comprising a power actuator comprising at least a motor operatively connected to a vehicle closure panel. A programmable controller is provided, configured to determine an optimal electrical current draw for the motor according to one or more inputs relating at least to a vehicle battery status, a vehicle-exterior ambient temperature, a vehicle grade, and a vehicle climate control system status. The input relating to the vehicle climate control system status is provided as a measure of vehicle passenger cabin air pressure. The system may further include one or more on-board or remotely located sensors for providing the one or more inputs relating at least to the vehicle ambient temperature and vehicle grade, in addition to sensors providing information on window open or close status, and/or air-extraction rate sensors. In embodiments, the powered closure panel may be one of a liftgate, a decklid, a tonneau cover, a side-hinged door, a hood, a trunk, a moving glass panel, and a tailgate.

In embodiments, the input relating to the vehicle climate control system status comprises a determination of a heating, ventilation, and air-conditioning (HVAC) blower setting. In an embodiment, this comprises an input indicative of the HVAC blower being set to a maximum speed or the HVAC blower being set to an off position. As will be appreciated, the maximum speed setting will have a highest impact on vehicle passenger cabin air pressure, whereas the off position setting will have a minimum impact on passenger cabin air pressure.

The input relating to vehicle battery status may comprise an input indicative of a vehicle battery voltage condition. In embodiments, the controller may be further configured to determine the optimal electrical current draw for the motor according to an additional input of a vehicle passenger cabin air extraction rate. This may be by way of inputs from one or more air flow sensors associated with one or more vehicle air extractors. A soft close functionality may be provided for the optimized vehicle closure panel.

In another aspect, a method is provided for optimizing electrical current draw of a vehicle power closure. The method comprises providing a power actuator comprising at least a motor operatively connected to a vehicle closure panel and to a closure panel lift member, providing a controller configured at least to determine an optimal electrical current draw for the power actuator according to one or more inputs relating at least to a vehicle battery status, a vehicle-exterior ambient temperature, a vehicle grade, and a vehicle climate control system status, and providing the determined optimum electrical current draw to the motor. The input relating to the vehicle climate control system status is representative of a vehicle passenger cabin air pressure. The power actuator may be associated with a power closure selected from the group consisting of a liftgate, a decklid, a tonneau cover, a side-hinged door, a hood, a trunk, a moving glass panel, and a tailgate. The one or more inputs may be provided by one or more on-board or remotely located sensors.

In embodiments, the method includes, by the controller, determining the vehicle climate control system status according to a heating, ventilation, and air-conditioning (HVAC) blower setting. This can comprise determining the HVAC blower setting as one of a maximum speed or an off position. In embodiments, the method may include operatively connecting the controller to a pulse width modulation module to provide the determined optimum electrical current draw to the motor.

In embodiments, the method includes further configuring the controller to determine the optimal electrical current draw for the motor according to an additional input of a vehicle passenger cabin air extraction rate. This may be effected by configuring the controller to receive inputs from one or more air flow sensors associated with one or more vehicle air extractors. The method may further include providing the power actuator to provide a soft close functionality to the vehicle closure panel.

In the following description, there are shown and described embodiments of the disclosed power closure panel performance optimizing systems and methods. As it should be realized, the systems and methods are capable of other, different embodiments and their several details are capable of modification in various, obvious aspects all without departing from the devices and methods as set forth and described in the following claims. Accordingly, the drawings and descriptions should be regarded as illustrative in nature and not as restrictive.

BRIEF DESCRIPTION OF THE DRAWINGS

The accompanying drawing figures incorporated herein and forming a part of the specification, illustrate several aspects of the disclosed power closure panel performance optimizing systems and methods, and together with the description serve to explain certain principles thereof. In the drawing.

Reference will now be made in detail to embodiments of the disclosed power closure panel performance optimizing systems and methods, examples of which are illustrated in the accompanying drawing figures.

DETAILED DESCRIPTION

Preliminarily, the disclosed power closure panel performance optimizing systems and methods are described herein primarily in the context of a power controlled vehicle liftgate. However, it will readily be appreciated that the systems and methods are equally applicable to any power-operated closure panels, including without intending any limitation decklids, tonneau covers, side-hinged doors, top-hinged doors, hoods, trunks, tailgates, and others. Use of the disclosed power closure panel performance optimizing systems and methods with any such alternative power controlled closure systems or closure panels is contemplated. Therefore, this portion of the disclosure shall not be taken as limiting.

Figure 1:
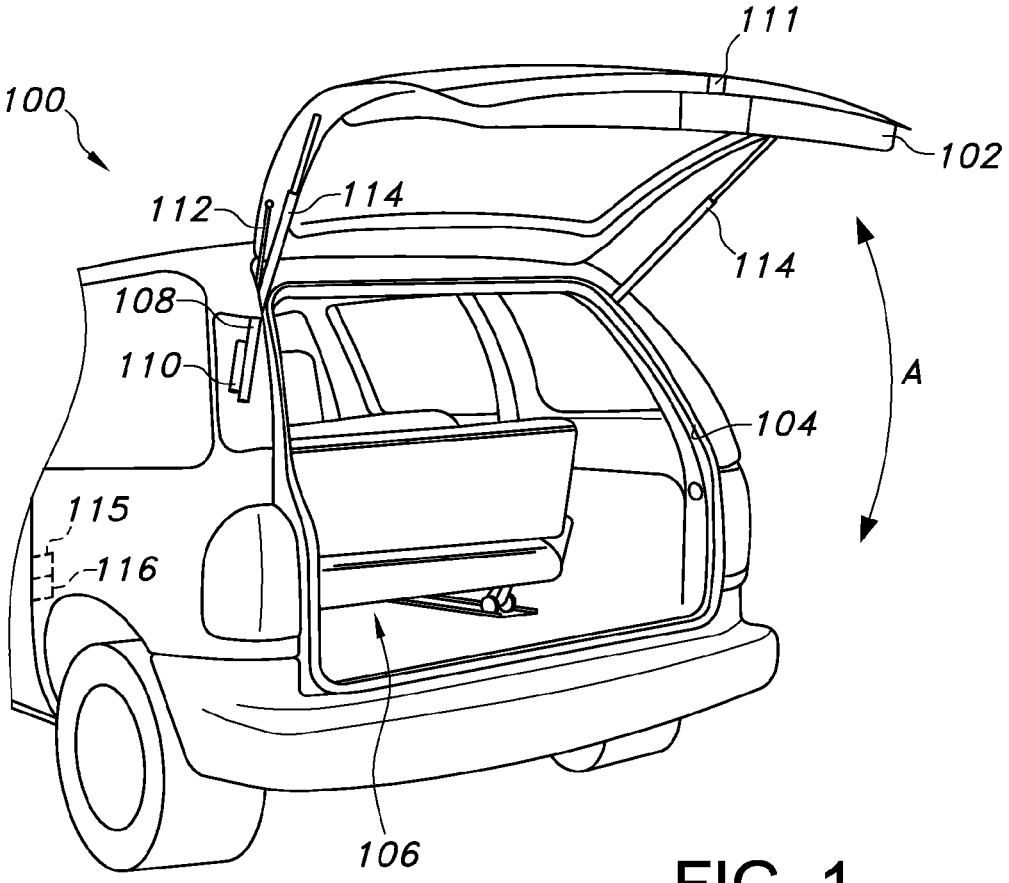
FIG. 1 depicts a vehicle including a counterbalanced power-assisted liftgate.

As set forth above and with reference to FIG. 1, it is known to provide a vehicle 100 including a power-operated closure panel such as a hinged liftgate 102 that engages a vehicle door frame 104 and latch (not shown) in a closed position and which raises to an open position as shown in FIG. 1 to allow access to a portion of the vehicle interior such as a cargo area 106.

A power actuator system 108 includes a motor 110 that actuates to translate the liftgate 102 between the open position shown in FIG. 1 and a closed position (see arrow A). The vehicle 100 may further include a motorized cinching striker or latch 111 for engaging a cooperating door frame latch or striker (not shown). A lift assist mechanism is included in the depicted embodiment, comprising a power strut 112 and one or more spring or gas operated counterbalance struts 114, or alternatively or in addition one or more, motor-operated spring counterbalanced struts, in the same relative position. As is known, the power strut 112 is operatively associated with the motor 110 and rotates the liftgate 102 about hinged attachment points between the open and closed positions. The counterbalance strut(s) 114 serve to hold or balance the liftgate 102 between the open and closed positions, thus reducing the torque and electrical current draw required of the motor 110 to open and close the liftgate.

The skilled artisan will appreciate that the disclosed power closure panel performance optimizing systems and methods are equally applicable to other power controlled closure systems/panels, for example dual powered systems (not shown) including a pair of power struts in addition to or instead of one or more counterbalance struts 114, or one or more motor-operated spring counterbalance struts, in the same relative position. While as shown the motor 110 is external to the power strut 112, it is also known to provide a motor internal to a linear power strut 112 or a counterbalance strut 114. Likewise, use of other lift assist mechanisms is contemplated, including without intending any limitation, powered systems, torsion springs, torsion bars, mechanical spring struts, gas/mechanical spring struts, and others.

Figure 2:
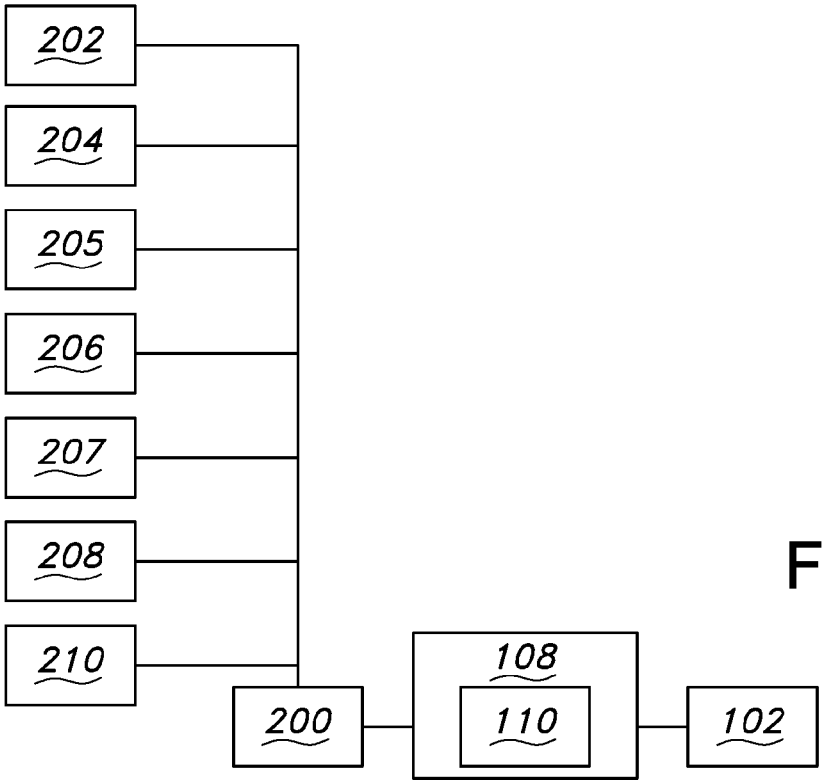
FIG. 2 depicts a controller system for the counterbalanced power-assisted liftgate of FIG. 1.

As shown in FIG. 2, a controller 200 is operatively connected to the power actuator system 108, and controls a supply of electrical current to the motor 110. The controller 200 may be an ECU dedicated to controlling the power actuator system 108, or may be part of another vehicle 100 system. The controller 200 is configured to receive a variety of inputs from one or more sensors associated with the vehicle 100 and from other vehicle systems. In an embodiment, the controller 200 receives inputs from at least one or more temperature sensors 202 and one or more vehicle grade sensors 204. In other embodiments, remote provision of inputs is contemplated, for example by way of remote sources 205 such as satellite or GPS systems providing temperature, weather, elevation, location/region, etc. inputs. Suitable temperature sensors 202, vehicle grade sensors 204, and remote sources 205 include without intending any limitation dedicated temperature sensors and accelerometer-based tilt sensors of known design, data from which is pulled over the vehicle controller area network (LIN) (CAN) bus. In other embodiments, a gyro-temperature sensor of known design is provided which provides both ambient temperature and grade data. In yet other embodiments, temperature (interior and/or exterior to the vehicle) and vehicle tilt sensors associated with an ECU board are used. In still other embodiments, input of remotely sourced data is contemplated, including remotely sourced ambient temperature data from remote sources 205.

The controller 200 also receives inputs from one or more of a battery voltage controller or sensor 206, a climate control system status controller or sensor 207, a closure panel programmable height system 208, and a motor pulse width modulation (PWM) module 210. In an embodiment, the battery voltage controller or sensor 206 is an ECU in direct connection to the battery which constantly monitors battery voltage.

In an embodiment, the climate control system status controller or sensor 207 is a dedicated ECU such as a blower control module which communicates with a central vehicle controller such as the Body Control Module (BCM) over the vehicle 100 CAN Bus, and provides an input to the BCM indicative of a climate control system blower setting. In embodiments, the input provided to the climate control system status controller or sensor 207 relating to the vehicle climate control system status comprises a determination of an HVAC blower setting. In an embodiment, this comprises an input indicative of the HVAC blower being set to a maximum speed or the HVAC blower being set to an off position. As will be appreciated, the maximum speed setting will have a highest impact on vehicle passenger cabin air pressure, whereas the off position setting will have a minimum impact on passenger cabin air pressure. Other embodiments contemplate remote monitoring of the climate control system status, blower control module, etc.

Optionally, measures of passenger cabin air exhaustion rates are provided by one or more air flow sensors 115 associated with one or more air extractors or air exhaustion ports 116 (see FIG. 1). As is known, an air extractor 116 may be provided to allow escape of air from a vehicle passenger cabin, thereby offsetting the negative effects of increased passenger cabin air pressure on the closing force required to close, e.g., a vehicle door or liftgate. The air flow sensor 115 may be any suitable sensor, including without intending any limitation an anemometer, a pitot tube, or others.

In turn, it is known to provide a "soft close" function to a closure panel. As is known, a soft close function reduces a closing speed of a closure panel such as liftgate 102 prior to engagement of a power lock or power cinch function effected by motorized cinching striker or latch 111. As will be appreciated, such a soft close function will, in addition to the primary function of a controlled, quiet closing of the closure panel, provide additional opportunity for air exhaustion from the passenger cabin, thus reducing passenger cabin air pressure. By this feature, the closing force needed to close the closure panel can be further reduced.

In still other embodiments, the climate control system status controller or sensor 207 may be further configured to minimize passenger cabin air pressure if the HVAC blower is set at a maximum speed, to minimize bounce back. As an example, this can be achieved by configuring the climate control system status controller or sensor 207 to control a vehicle window motor (not shown) to lower the window glass (not shown) during closure panel (liftgate 102, etc.) closing. Thus, an alternative soft close function is contemplated.

By the above climate control system status controller or sensor 207 and/or air flow sensor 115, as will be appreciated by the skilled artisan inputs indicative of a passenger cabin/cargo area air pressure and/or a rate of air extraction from the vehicle passenger cabin/cargo area are provided. In addition to the above-described inputs of ambient temperature, vehicle grade, and battery voltage, as will be described this allows the most efficient possible operation of the power actuator system 108/motor 110, i.e. controlling the operation of the power actuator system 108/motor 110 whereby an optimal liftgate 102 closing speed/force can be applied at an optimal supplied electrical current according to the supplied inputs.

Figure 3:
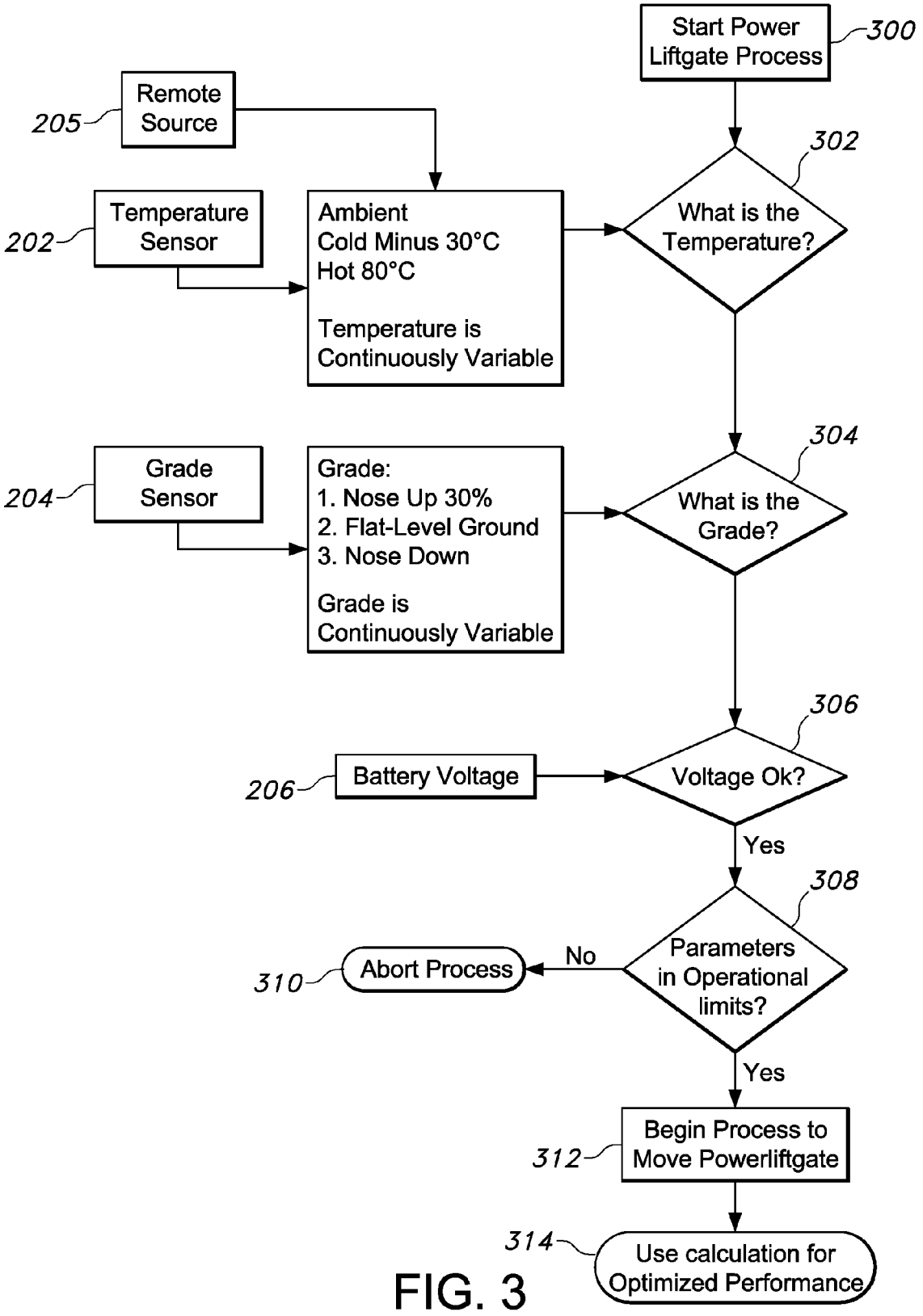
FIG. 3 depicts in flow chart form a control scheme for the controller system of FIG. 2.

The controller 200 utilizes the above-described inputs to continuously control the behavior and performance of the power actuator system 108/motor 110 in order to control electrical current draw by the power actuator system. This is illustrated in flow chart form in FIG. 3. As shown, in step 300 a process of translating a liftgate 102 between an open and closed configuration is initiated. At step 302, the controller 200 receives temperature data from a temperature sensor 202 and/or a remote source 205. In one embodiment, the controller 200 modifies the behavior of the power actuator system 108 according to whether the temperature is ambient, extreme cold, or extreme heat. In this embodiment, temperature is a continuous variable.

At step 304, the controller 200 receives vehicle grade data from a grade sensor 204. In one embodiment, the controller 200 modifies the behavior of the power actuator system 108 according to whether the vehicle 100 is on level ground, i.e. oriented to define a plane substantially parallel to a horizontal plane, in a "nose-up" orientation of +30% or more from the horizontal plane, or in a "nose-down" orientation of −30% or more from the horizontal plane. In this embodiment, vehicle grade is a continuous variable.

Optionally, at step 306 the controller 200 receives vehicle battery voltage data from a voltage sensor 206 (for example, a sensor comprised in a control module), and determines whether the voltage is within pre-defined operational limits (step 308). If not, at step 310 the process is terminated and optionally a signal is sent to a user such as the vehicle 100 driver interface indicating that the battery voltage is insufficient to operate the power actuator system 108. If so, the process of translating the closure panel is initiated (step 312). At step 314, the controller 200 calculates optimum operating parameters for the power actuator system 108 according to at least the ambient temperature, climate settings, and vehicle grade inputs described above, and optionally for other of the various inputs described above.

In one embodiment, the controller 200 is configured to apply a multiple linear regression analysis to solve equations with multiple continuously variable inputs and multiple continuously variable responses (OUTPUTS) simultaneously. By incorporating such multiple inputs/multiple responses, a multiple response optimizer routine is provided allowing determination of optimal electrical current draw by components of the power actuator system 108, such as the motor 110 and/or the striker/latch 111 motor, according to multiple inputs as described above. As described, the inputs include at least temperature and vehicle grade, but may also include one or more of battery voltage, predetermined closure panel opening height, motor pulse width modulation, and others. The responses may include one or more of electrical current draw, closure panel speed of opening/closing, and obstacle forces. The Multiple Linear Regression Equation used in the analysis is in fact an Operation Control Model of all of the important Factors required to operate a closure panel such as liftgate 102 successfully. The Coefficient of Determination (or R-Squared Value) demonstrates the effectiveness of the Model. The closer Coefficient of Determination is to 1.0, the more variation explained by the Model, and the better the Models predictability, and fit of the actual data, to that predicted by the Model.

A representative analysis for a multiple response optimizer routine for determining optimal operation of a module controlled, or micro-computer controlled closure panel power actuator system will now be discussed. The analysis determines interactions between various factors and uses those interactions to optimize component useful lifetime, by reducing electrical current draw on main components such as the motor 110. This is because as is known, high electrical current draw causes electro-mechanical system wear and premature component failure due to over-current stress conditions, heat, and induced mechanical wear and tear.

The sample analyzed presented in Table 1 below includes a range of temperature inputs of (−30° C. versus 20° C.), vehicle grade (30% decline versus 30% incline), and vehicle battery voltage (10 V versus 12 V). Other analyses shown below compare temperature inputs of 50° C. and vehicle battery voltage of 16 V.

TABLE 1

A Model description produced from a Multiple Linear Regression analysis for determination of the power-actuator optimum system performance.

| TERM | Coef | SE Coef | T | P-Value |
|---|---|---|---|---|
| Constant | 105.415 | .0340 | 310.29 | 0.000 |
| Temperature | | | | |
| −30° C. | −34.1704 | 0.4805 | −71.12 | 0.000 |
| 20° C. | 7.3407 | 0.4805 | 15.28 | 0.000 |
| Grade | | | | |
| 30% Decline | 21.7407 | 0.4805 | 45.25 | 0.000 |
| 30% Incline | −19.2148 | 0.4805 | −39.99 | 0.000 |
| Voltage (@ source) | | | | |
| 10 V | −7.1037 | 0.4805 | −14.79 | 0.000 |
| 12 V | −3.3704 | 0.4805 | −7.01 | 0.000 |

S=3.94734, R-Sq=98.91%, R-Sq (adjusted)=98.64%, wherein R-Sq (adjusted) is a Coefficient of Determination, i.e. a value showing how much of an observed variation in responses is explained by the main factors of temperature, vehicle grade, and voltage (100%=maximum); a coefficient with a P-value of less than 0.05 is significant, Coef=Coefficient; SE=Standard error; and S=Estimate of Standard Deviation.

For a temperature of −30° C. and a 30% decline, the calculation is:

$$95.4\ \text{Force}\ (N)=105.4-34.17\times(-30^\circ\ \text{C.})+21.7\times(30\%\ \text{decline})-7.103\times(10\text{V}),$$

This can be correlated to the Speed or Amps as they are directly proportional.

For a temperature of 20° C. and a 30% incline, the calculation is:

$$97\ \text{Force}\ (N)=105.4+7.34\times(20^\circ\ \text{C.})-19.21\times(30\%\ \text{incline})-3.37\times(12\text{V}),$$

Force is correlated with Speed, and Amps.

Thus, as can be seen by the described analyses the optimal electrical current draw for particular environmental conditions may be determined by the controller 200 and supplied to the power actuator system 108 according to various inputs of temperature, vehicle grade, and battery voltage. This determined electrical current draw may be supplied to the power actuator system 108 by any suitable means, for example by a motor 110 driven by a pulse width modulation module.

The General Linear Regression Model for this process is very unique as the P-Value for the Interaction Groupings under the "Source" column (see Table 2 below) shows that overall of the groups are considered significant, that is they have none zero coefficient. This means that these Factors can be used to calculate the predicted value with high degree certainty. As shown, the Coefficient of Determination is 98%, and so the model explains 98% of the variation in the measured data. Because more predictors can be used, the analysis is highly sensitive to these variables and so ultimately more accurate control can be exerted over the electro-mechanical components. This ultimately allows very quickly fine tuning the processes for longer component lifetime due to less unnecessary electrical wear and tear. Advantageously, the model eliminates certain variables (50° C., Level Ground, and battery voltage of 16 V) further simplifying the number of Process Factors levels that may be needed to accurately develop the model for similar power actuator systems. As will be appreciated, this model may be used to develop a suitable lookup table of optimal electrical current draws for particular environmental conditions for accessing by the controller 200.

TABLE 2

General Linear Model.

General Linear Model: 8N-Closing f, 6N-Closing f versus Temperature, Grade, . . .

| Factor | Type | Levels | Values |
|---|---|---|---|
| Temperature | fixed | 3 | −30° C., 20° C., 50° C. |
| Grade | fixed | 3 | Decline, Incline, Level |
| Voltage (@ supply) | fixed | 3 | 10 V, 12 V, 16 V |

Analysis of Variance for 8N-Closing force 1°
Analysis of Variance for 8N-Closing force 1° (N), using Adjusted SS for Tests

| Source | DF | Seq SS | Adj SS | Adj MS | F | P |
|---|---|---|---|---|---|---|
| Temperature | 2 | 68035.1 | 68035.1 | 34017.6 | 802.72 | 0.000 |
| Grade | 2 | 33798.5 | 33798.5 | 16899.3 | 398.78 | 0.000 |
| Voltage (@ supply) | 2 | 18727.2 | 18727.2 | 9363.6 | 220.96 | 0.000 |
| Temperature*Grade | 4 | 9758.7 | 9758.7 | 2439.7 | 57.57 | 0.000 |
| Temperature*Voltage (@ supply) | 4 | 2097.5 | 2097.5 | 524.4 | 12.37 | 0.000 |
| Grade*Voltage (@ supply) | 4 | 728.9 | 728.9 | 182.2 | 4.30 | 0.003 |
| Temperature*Grade*Voltage (@ supply) | 8 | 7200.6 | 7200.6 | 900.1 | 21.24 | 0.000 |
| Error | 108 | 4576.8 | 4576.8 | 42.4 | | |
| Total | 134 | 144923.3 | | | | |

Table 3 is a typical Analysis of Variance ANOVA Table showing the number of key terms or predictors, Coefficients, Standard Deviation of the Coefficients, T-Value and P-Values. The low P-Values indicate that the Coefficients are non-zero, and are significant in calculating the equations above, for Force, Speed, or Amperage.

TABLE 3

Representative ANOVA analysis.
Linear Model:
S = 3.94734 R-Sq = 98.91% R-Sq(adj) = 98.64%

| Term | | Coef | SE Coef | T | P |
|---|---|---|---|---|---|
| Constant | | 105.415 | 0.340 | 310.29 | 0.000 |
| Temperature | | | | | |
| −30° C. | | −34.1704 | 0.4805 | −71.12 | 0.000 |
| 20° C. | | 7.3407 | 0.4805 | 15.26 | 0.000 |
| Grade | | | | | |
| Decline | | 21.7407 | 0.4805 | 45.25 | 0.000 |
| Incline | | −19.2146 | 0.4805 | −39.99 | 0.000 |
| Voltage (@ source) | | | | | |
| 10 V | | −7.1037 | 0.4805 | −14.79 | 0.000 |
| 12 V | | −3.3704 | 0.4805 | −7.01 | 0.000 |
| Temperature*Grade | | | | | |
| −30° C. | Decline | 3.1481 | 0.6795 | 4.63 | 0.000 |
| −30° C. | Incline | 0.2370 | 0.6795 | 0.35 | 0.728 |
| 20° C. | Decline | −1.2963 | 0.6795 | −1.91 | 0.059 |
| 20° C. | Incline | 7.2593 | 0.6795 | 10.68 | 0.000 |
| Temperature*Voltage (@ source) | | | | | |
| −30° C. | 10 V | −4.4074 | 0.6795 | −6.49 | 0.000 |
| −30° C. | 12 V | −5.8074 | 0.6795 | −8.55 | 0.000 |
| 20° C. | 10 V | 2.5481 | 0.6795 | 3.75 | 0.000 |
| 20° C. | 12 V | 2.7481 | 0.6795 | 4.04 | 0.000 |

TABLE 3-continued

Representative ANOVA analysis.
Linear Model:
S = 3.94734 R-Sq = 98.91% R-Sq(adj) = 98.64%

| Term | | Coef | SE Coef | T | P |
|---|---|---|---|---|---|
| Grade*Voltage (@ source) | | | | | |
| Decline 10 V | | −6.5185 | 0.6795 | −9.59 | 0.000 |
| Decline 12 V | | −4.0519 | 0.6795 | −5.96 | 0.000 |
| Incline 10 V | | 3.7037 | 0.6795 | 5.45 | 0.000 |
| Incline 12 V | | 1.3704 | 0.6795 | 2.02 | 0.046 |
| Temperature*Grade*Voltage (@ source) | | | | | |
| −30° C. | Decline 10 V | −8.5037 | 0.9609 | −8.85 | 0.000 |
| −30° C. | Decline 12 V | −11.1037 | 0.9609 | −11.56 | 0.000 |
| −30° C. | Incline 10 V | 0.1407 | 0.9609 | 0.15 | 0.884 |
| −30° C. | Incline 12 V | 3.3407 | 0.9609 | 3.48 | 0.001 |
| 20° C. | Decline 10 V | 4.4741 | 0.9609 | 4.66 | 0.000 |

Again, the Model has eliminated the high temperature of 50 C, the Grade of Level Ground, and the high Voltage of 16V. This means that these parameters can ultimately be eliminated from the analysis, and future parameter-defining experimental designs, further reducing the time, effort and resources in the Control-Model development process.

Table 4 shows the impact of Temperature, Grade and voltage alone, and also shows the interactions of Temperature*Grade, Temperature*Voltage, and Grade*Voltage. Analysis of these Interactions allows the developer to include a combination of factor interactions whose effects cannot be known by intuition. Being able to determine these interactions and their impact on the accuracy of the Model is what ultimately give this process its predictability and usefulness in developing a deeper understanding of the variable relationships and the process being controlled.

TABLE 4

| Analysis of Interactions. Least Squares Means | | 8N Closing force 1° (N) | |
|---|---|---|---|
| | | Mean | SE Mean |
| Temperature | | | |
| −30° C. | | 80.36 | 0.9704 |
| 20° C. | | 119.49 | 0.9704 |
| 50° C. | | 133.38 | 0.9704 |
| Grade | | | |
| Decline | | 130.98 | 0.9704 |
| Incline | | 92.27 | 0.9704 |
| Level | | 109.98 | 0.9704 |
| Voltage (@ supply) | | | |
| 10 V | | 99.67 | 0.9704 |
| 12 V | | 106.27 | 0.9704 |
| 16 V | | 127.29 | 0.9704 |
| Temperature*Grade | | | |
| −30° C. | Decline | 115.60 | 1.6808 |
| −30° C. | Incline | 55.20 | 1.6808 |
| −30° C. | Level | 70.27 | 1.6808 |
| 20° C. | Decline | 134.07 | 1.6808 |
| 20° C. | Incline | 107.67 | 1.6808 |
| 20° C. | Level | 116.73 | 1.6808 |
| 50° C. | Decline | 143.27 | 1.6808 |
| 50° C. | Incline | 113.93 | 1.6808 |
| 50° C. | Level | 142.93 | 1.6808 |
| Temperature*Voltage (@ source) | | | |
| −30° C. | 10 V | 67.27 | 1.6808 |
| −30° C. | 12 V | 71.40 | 1.6808 |
| −30° C. | 16 V | 102.40 | 1.6808 |
| 20° C. | 10 V | 105.13 | 1.6808 |
| 20° C. | 12 V | 116.67 | 1.6808 |
| 20° C. | 16 V | 136.67 | 1.6808 |
| 50° C. | 10 V | 126.60 | 1.6808 |
| 50° C. | 12 V | 130.73 | 1.6808 |
| 50° C. | 16 V | 142.80 | 1.6808 |
| Grade*Voltage (@ source) | | | |
| Decline 10 V | | 118.47 | 1.6808 |
| Decline 12 V | | 123.53 | 1.6808 |
| Decline 16 V | | 150.93 | 1.6808 |
| Incline 10 V | | 83.47 | 1.6808 |
| Incline 12 V | | 86.93 | 1.6808 |
| Incline 16 V | | 106.40 | 1.6808 |
| Level 10 V | | 97.07 | 1.6808 |

Figure 4:
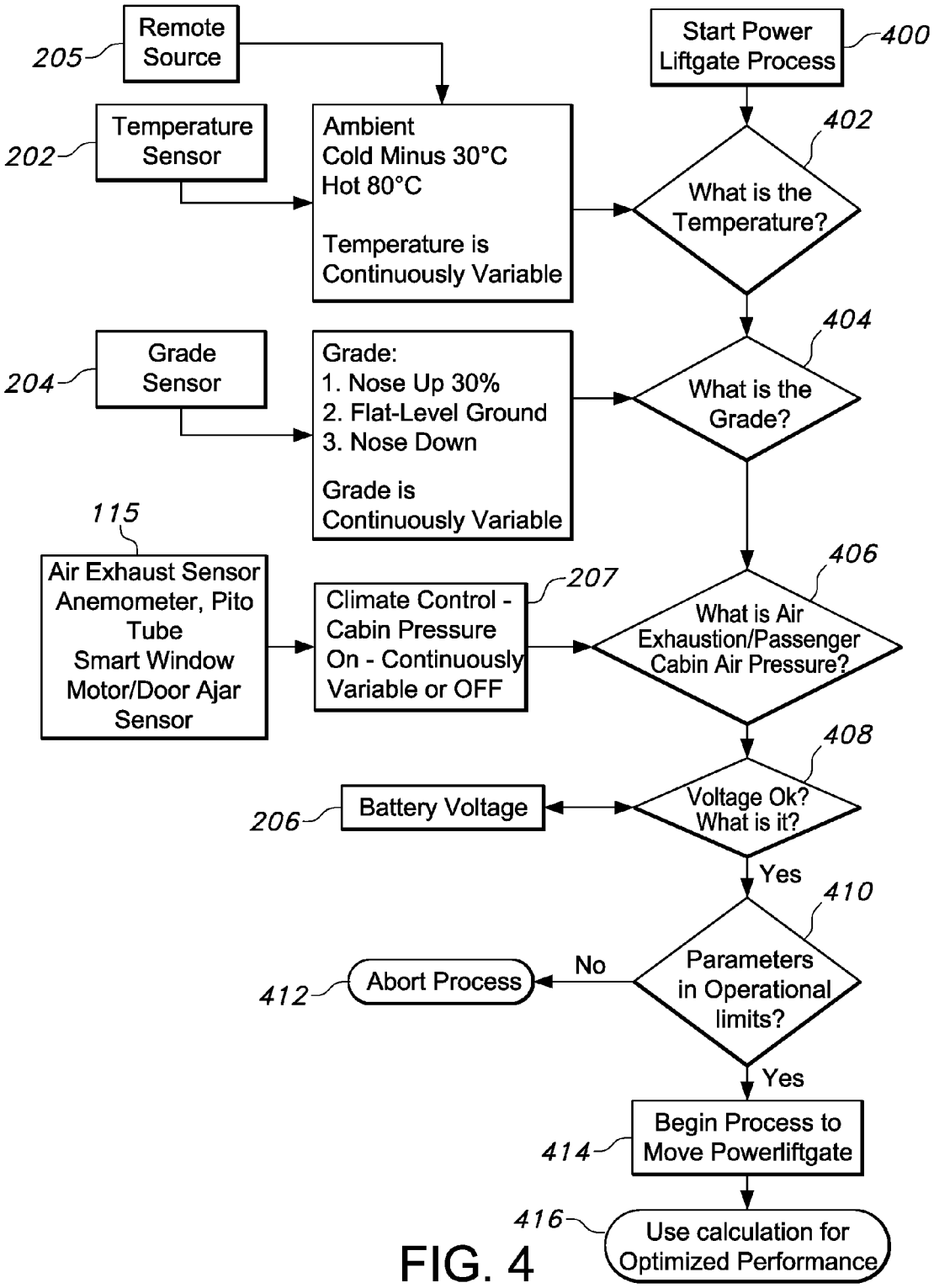
FIG. 4 depicts in flow chart form an alternative embodiment of a control scheme for the controller system of FIG. 2.

In an alternative embodiment illustrated in flow chart form in FIG. 4, the controller 200 utilizes the above-described and other inputs to continuously control the behavior and performance of the power actuator system 108/motor 110 in order to control electrical current draw by the power actuator system and optionally the latching system. The closure panel speed and therefore forces imparted to obstacles in the path of the power closure can be minimized. Again, the controller 200 may be a dedicated ECU configured to monitor various sensor inputs as will be described below or may be a controller associated with another vehicle system. As shown, in step 400 a process of translating a liftgate 102 between an open and closed configuration is initiated. At step 402, the controller 200 receives temperature data from a temperature sensor 202 and/or a remote source 205. In one embodiment, the controller 200 modifies the behavior of the power actuator system 108 according to whether the temperature is ambient, extreme cold (in an embodiment, 30° C. or less), or extreme heat (80° C. or more). In this embodiment, temperature is a continuous variable.

At step 404, the controller 200 receives vehicle grade data from a grade sensor 204. In one embodiment, the controller 200 modifies the behavior of the power actuator system 108 according to whether the vehicle 100 is on level ground, i.e. substantially parallel to a horizontal plane, in a "nose-up" orientation of +30% or more from the horizontal plane, or in a "nose-down" orientation of −30% or more from the horizontal plane. In this embodiment, vehicle grade is a continuous variable.

At step 406, the controller 200 receives inputs from the climate control system status sensor 207 and/or air flow sensor 115, indicative of the passenger cabin/cargo area air pressure and/or a rate of air extraction/exhaustion from the vehicle passenger cabin/cargo area as described above.

At step 408 the controller 200 receives an input representative of vehicle battery voltage data from a voltage sensor 206, and determines whether the voltage is within pre-defined operational limits.

Next, at step 410 the controller 200 determines whether the above-described inputs indicate that the ambient temperature, vehicle grade, battery voltage, and passenger cabin/cargo area air pressure and/or rate of air extraction parameters are within predefined operational limits. If not, at step 412 the process is terminated and optionally a signal is sent to a user such as the vehicle 100 driver, or to a vehicle diagnostic system (not shown), indicating that the battery voltage is insufficient to operate the power actuator system 108. If so, the process of translating the closure panel is initiated (step 414). At step 416, the controller 200 calculates optimum operating parameters for the power actuator system 108 according to at least the ambient temperature, vehicle grade, battery voltage, climate control system status, and interaction inputs, and optionally for other of the various inputs described above.

In the alternative embodiment illustrated in FIG. 4, the controller 200 is configured to apply a multiple linear regression analysis to solve equations with multiple continuously variable inputs and multiple continuously variable responses simultaneously. By incorporating such multiple inputs/multiple responses, a multiple response optimizer routine is provided allowing determination of optimal electrical current draw by components of the power actuator system 108, such as the motor 110 and/or the striker/latch 111 motor, according to multiple inputs as described above. As described, the inputs include ambient temperature, vehicle grade, battery voltage, and climate control system status. The inputs may also include one or more of predetermined closure panel opening height, motor pulse width modulation, and others. The responses may include one or more of electrical current draw, closure panel speed of opening/closing, and obstacle forces.

A representative analysis for a multiple response optimizer routine for determining optimal operation of a module controlled, or micro-computer controlled closure panel power actuator system using inputs of ambient temperature, vehicle grade, battery voltage, and passenger cabin air pressure (interpolated from climate control system status) will now be discussed. The analysis determines interactions between various factors and uses those interactions to optimize component useful lifetime, by reducing electrical current draw on main components such as the motor 110. This is because as is known, high electrical current draw causes electro-mechanical system wear and premature component failure due to over-current conditions, heat, and induced mechanical wear and tear. By the above-described systems, the electrical current supplied to main components such as the motor 110 is adapted to the environment according to the supplied inputs, and provides optimum closing forces for the closure panel according to the determined ambient temperature, vehicle grade, battery voltage, and climate control system status inputs supplied to the controller 200. A representative regression equation for this analysis is: Closing Force=29.4+2.479 Voltage+0.5323 Grade+0.4178 Temperature+0.4104 Climate Control. As described below, the accuracy of the Regression Equation prediction was determined to be greater than 98% (coefficient of determination or R-Squared value).

An experiment was designed to test significance of ambient temperature, vehicle grade, battery voltage, and climate control system status inputs on closing force for a closure panel. As summarized below in Table 5, the experiment compared battery voltages of 14V and 16V, vehicle grades of −20 degrees and 20 degrees, and ambient temperatures of −30 □ and 80 □. The experiment also compared a climate control systems status of 0 (i.e., HVAC blower off) and 100 (i.e., HVAC blower at maximum).

TABLE 5

Parameter Design Of Experimental Settings.

| Row | Voltage | Grade | Temp. | Climate Control | Closing Force |
|---|---|---|---|---|---|
| 1 | 14 | −20 | −30 | 0 | 38.000 |
| 2 | 16 | −20 | −30 | 0 | 45.833 |
| 3 | 14 | 20 | −30 | 0 | 67.667 |
| 4 | 16 | 20 | −30 | 0 | 62.500 |
| 5 | 14 | −20 | 80 | 0 | 87.833 |
| 6 | 16 | −20 | 80 | 0 | 91.667 |
| 7 | 14 | 20 | 80 | 0 | 107.500 |
| 8 | 16 | 20 | 80 | 0 | 115.333 |
| 9 | 14 | −20 | −30 | 100 | 82.667 |
| 10 | 16 | −20 | −30 | 100 | 87.500 |
| 11 | 14 | 20 | −30 | 100 | 103.333 |
| 12 | 16 | 20 | −30 | 100 | 109.167 |
| 13 | 14 | −20 | 80 | 100 | 128.500 |
| 14 | 16 | −20 | 80 | 100 | 133.333 |
| 15 | 14 | 20 | 80 | 100 | 145.167 |
| 16 | 16 | 20 | 80 | 100 | 155.000 |

Table 6 presents a regression analysis (analysis of variance) of the above inputs (battery voltage, ambient temperature, vehicle grade, and climate control system status) according to the above-described regression equation. Table 7 presents a summary of the analysis model. Table 8 presents the coefficients of variation and confidence intervals (CI) for the predicted interval for the applied closing force according to the variables (inputs), and Table 9 presents fits and diagnostics for all observations.

TABLE 6

Regression Analysis: Response versus Voltage, Grade, Temperature, Climate Control.

| Source | DF | Seq SS | Contribution | Adj SS | Adj MS | F-Value | P-Value |
|---|---|---|---|---|---|---|---|
| Regression | 4 | 17098.0 | 99.50% | 17098.0 | 4274.51 | 548.73 | 0.000 |
| Voltage | 1 | 98.3 | 0.57% | 98.3 | 98.34 | 12.62 | 0.005 |
| Grade | 1 | 1813.3 | 10.55% | 1813.3 | 1813.34 | 232.78 | 0.000 |
| Temperature | 1 | 8448.7 | 49.17% | 8448.7 | 8448.67 | 1084.59 | 0.000 |
| Climate Control | 1 | 6737.7 | 39.21% | 6737.7 | 6737.67 | 864.94 | 0.000 |
| Error | 11 | 85.7 | 0.50% | 85.7 | 7.79 | | |
| Total | 15 | 17183.7 | 100.00% | | | | |

TABLE 7

Model Summary.

| S | R-sq | R-sq(adj) | PRESS | R-sq(pred) |
|---|---|---|---|---|
| 2.79102 | 99.50% | 99.32% | 181.289 | 98.94% |

The model summary in Table 7 indicates a predicted R-squared value (Coefficient of Determination) of 98.94%, which indicates that over 98% of the observed variation in required powered closure panel closing force is attributable to the examined variables of battery voltage, vehicle grade, ambient temperature, and passenger cabin air pressure (as indicated by HVAC blower setting).

TABLE 8

Coefficients.

| Term | Coef SE | Coef | 95% CI | T-Value | P-Value |
|---|---|---|---|---|---|
| Constant | 29.4 | 10.5 | (6.3, 52.6) | 2.80 | 0.017 |
| Voltage | 2.479 | 0.698 | (0.943, 4.015) | 3.55 | 0.005 |
| Grade | 0.5323 | 0.0349 | (0.4555, 0.6091) | 15.26 | 0.000 |
| Temperature | 0.4178 | 0.0127 | (0.3899, 0.4457) | 32.93 | 0.000 |
| Climate Control | 0.4104 | 0.0140 | (0.3797, 0.4411) | 29.41 | 0.000 |

The P-values (all below 0.05) indicate the significance of the inputs on closing force.

TABLE 9

Fits and diagnostics for all observations.

| Obs | Closing Force | Fit | SE Fit | 95% CI |
|---|---|---|---|---|
| 1 | 38.00 | 40.94 | 1.56 | (37.50, 44.37) |
| 2 | 45.83 | 45.90 | 1.56 | (42.46, 49.33) |
| 3 | 67.67 | 62.23 | 1.56 | (58.80, 65.66) |
| 4 | 62.50 | 67.19 | 1.56 | (63.75, 70.62) |
| 5 | 87.83 | 86.90 | 1.56 | (83.46, 90.33) |
| 6 | 91.67 | 91.85 | 1.56 | (88.42, 95.29) |
| 7 | 107.50 | 108.19 | 1.56 | (104.75, 111.62) |
| 8 | 115.33 | 113.15 | 1.56 | (109.71, 116.58) |
| 9 | 82.67 | 81.98 | 1.56 | (78.55, 85.41) |
| 10 | 87.50 | 86.94 | 1.56 | (83.50, 90.37) |
| 11 | 103.33 | 103.27 | 1.56 | (99.84, 106.70) |
| 12 | 109.17 | 108.23 | 1.56 | (104.80, 111.66) |
| 13 | 128.50 | 127.94 | 1.56 | (124.50, 131.37) |
| 14 | 133.33 | 132.90 | 1.56 | (129.46, 136.33) |
| 15 | 145.17 | 149.23 | 1.56 | (145.80, 152.66) |
| 16 | 155.00 | 154.19 | 1.56 | (150.75, 157.62) |

Another representative analysis is provided in Table 10 below. The sample analyzed included a range of temperature inputs (−30° C. versus 20° C.), vehicle grades (30% decline versus 30% incline), vehicle battery voltage (10 V versus 12 V), climate control system status (represented as HVAC blower settings of 0 through 100 as described above), and also an air exhaustion rate input as described above, provided by an air flow sensors 115 comprising a pitot tube.

TABLE 10

A Model description produced from a Multiple Linear Regression analysis for determination of optimum power actuator system operation.

| TERM | Coef | SE Coef | T | P-Value |
|---|---|---|---|---|
| Constant | 105.415 | .0340 | 310.29 | 0.000 |
| Temperature | | | | |
| −30° C. | −34.1704 | 0.4805 | −71.12 | 0.000 |
| 20° C. | 7.3407 | 0.4805 | 15.28 | 0.000 |
| Grade | | | | |
| 30% Decline | 21.7407 | 0.4805 | 45.25 | 0.000 |
| 30% Incline | −19.2148 | 0.4805 | −39.99 | 0.000 |
| Voltage (@ source) | | | | |
| 10 V | −7.1037 | 0.4805 | −14.79 | 0.000 |
| 12 V | −3.3704 | 0.4805 | −7.01 | 0.000 |
| Cabin Pressure (HVAC blower setting, air exhaustion) | | | | |
| On or Continuous Variable | 30.56 | 0.545 | −5.34 | 0.005 |
| Off | 0.0 | 0.0 | 0.0 | 0.0 |

For a temperature of −30° C., a 30% decline, and a battery voltage of 10V, the calculation is:

145.4 Force ($N$)=105.4−34.17×(−30° C.)+21.7×(30% decline)−7.103×(10V)+30.56×(HVAC Blower setting/Air Exhaustion).

For a temperature of 20° C., a 30% incline, and a battery voltage of 12V, the calculation is:

97 Force ($N$)=105.4+7.34×(20° C.)−19.21×(30% incline)−3.37×(12V)+0×(HVAC Blower setting/Air Exhaustion).

Thus, according to the described alternative embodiment, as can be seen by the analyses the optimal electrical current draw for particular environmental conditions may be determined by the controller 200 and supplied to elements of the power actuator system 108 according to various inputs of ambient temperature, vehicle grade, battery voltage, and climate control system status. This determined electrical current draw may be supplied to the power actuator system 108 by any suitable means, for example by a motor 110 driven by a pulse width modulation module.

The General Linear Regression Model for this process is very unique, since as described above the P-Values for the various inputs show that each variable (ambient temperature, vehicle grade, battery voltage, climate control system status, and optionally air exhaustion rate) can be considered significant. This means that these Factors can be used to calculate a predicted closing force value with a high degree of certainty. As shown, the Coefficient of Determination (R-squared) is greater than 98%, and so the model explains over 98% of the variation in the measured data. Because more predictors can be used, the analysis is highly sensitive to these variables and so ultimately more accurate control can be exerted over the electro-mechanical components. This ultimately allows very quickly fine tuning the processes for longer component lifetime due to less unnecessary electrical wear and tear. As will be appreciated, this model may be used to develop a suitable lookup table of optimal electrical current draws for particular environmental conditions for accessing by the controller 200.

Numerous advantages accrue to the power closure panel performance optimizing systems and methods as described above. Because the system is applied to a counterbalanced power closure panel system, use of a smaller motor is made possible. This reduces weight, and costs, thereby contributing to design efficiency. By determining optimum electrical current draw for a power actuator system 108 according to environmental variables such as battery voltage, ambient temperature, vehicle grade, climate control system status, and air exhaustion rate, component efficiency is maximized and useful lifespan of components such as motors, and also ancillary components such as cinching latches, cinching strikers, and attachment mountings, and their component life, etc. is optimized and therefore, increased to the benefit of the consumer and the producer. Moreover, the described systems and methods allow rapid deployment of software for controlling the power actuator system and also much more rapid software design changes, updates, calibration/recalibration, and validation are more efficiently achieved.

Obvious modifications and variations are possible in light of the above teachings. All such modifications and variations are within the scope of the appended claims when interpreted in accordance with the breadth to which they are fairly, legally and equitably entitled.

What is claimed:

1. A power optimizer system for a vehicle, comprising:

a power actuator comprising at least a motor operatively connected to a vehicle closure panel; and a controller configured to determine an optimal electrical current draw for the motor according to one or more inputs relating at least to a vehicle battery status, a vehicle-exterior ambient temperature, a vehicle grade, and a vehicle climate control system status.

2. The system of claim 1, wherein the powered closure panel is selected from the group consisting of a liftgate, a decklid, a tonneau cover, a side-hinged door, a hood, a trunk, a moving glass panel, and a tailgate.

3. The system of claim 1, wherein the input relating to the vehicle climate control system status comprises a determination of a heating, ventilation, and air-conditioning (HVAC) blower setting.

4. The system of claim 3, wherein the input relating to vehicle climate control system status comprises an input indicative of the HVAC blower being set to a maximum speed or the HVAC blower being set to an off position.

5. The system of claim 1, further including one or more on-board or remotely located sensors or controllers for providing the one or more inputs relating at least to the vehicle ambient temperature, vehicle grade, vehicle battery status, and vehicle climate control system status.

6. The system of claim 1, wherein the vehicle battery status comprises an input indicative of a vehicle battery voltage condition.

7. The system of claim 1, wherein the controller is further configured to determine the optimal electrical current draw for the motor according to an additional input of a vehicle passenger cabin air extraction rate.

8. The system of claim 7, wherein the controller is further configured to receive inputs from one or more air flow sensors associated with one or more vehicle air extractors.

9. The system of claim 8, wherein the power actuator is further configured to provide a soft close functionality to the vehicle closure panel.

10. A vehicle including the system of claim 1.

11. A method for optimizing electrical current draw of a vehicle power closure, comprising:

providing a power actuator comprising at least a motor operatively connected to a vehicle closure panel and to a closure panel lift member;

providing a controller configured at least to determine an optimal electrical current draw for the power actuator according to one or more inputs relating at least to a vehicle battery status, a vehicle-exterior ambient temperature, a vehicle grade, and a vehicle climate control system status; and providing the determined optimum electrical current draw to the motor.

12. The method of claim 11, including operatively associating the power actuator with a power closure selected from the group consisting of a liftgate, a decklid, a tonneau cover, a side-hinged door, a hood, a trunk, a moving glass panel, and a tailgate.

13. The method of claim 11, including, by the controller, determining the vehicle climate control system status according to a heating, ventilation, and air-conditioning (HVAC) blower setting.

14. The method of claim 13, including, by the controller, determining the HVAC blower setting as one of a maximum speed or an off position.

15. The method of claim 11, including operatively connecting the controller to a pulse width modulation module to provide the determined optimum electrical current draw to the motor.

16. The method of claim 11, including providing one or more on-board or remotely located sensors or controllers for providing the inputs relating at least to the vehicle ambient temperature, vehicle grade, vehicle battery status, and vehicle climate control system status.

17. The method of claim 11, including further configuring the controller to determine the optimal electrical current draw for the motor according to an additional input of a vehicle passenger cabin air extraction rate.

18. The method of claim 17, including configuring the controller to receive inputs from one or more air flow sensors associated with one or more vehicle air extractors.

19. The method of claim 18, further including configuring the power actuator to provide a soft close functionality to the vehicle closure panel.

* * * * *